United States Patent [19]

Langowski et al.

[11] Patent Number: 4,462,733

[45] Date of Patent: Jul. 31, 1984

[54] BEAM TYPE RACKING SYSTEM

[75] Inventors: Faustyn C. Langowski, Georgetown; Joe R. Berry, Round Rock; Joseph R. Priest, Austin, all of Tex.

[73] Assignee: Hughes Tool Company, Houston, Tex.

[21] Appl. No.: 371,144

[22] Filed: Apr. 23, 1982

[51] Int. Cl.[3] ..... E21B 19/14

[52] U.S. Cl. ..... 414/22; 254/415

[58] Field of Search ..... 414/22, 630, 633, 745; 254/387, 415; 212/205, 213, 214

[56] References Cited

U.S. PATENT DOCUMENTS

| | | | |
|---|---|---|---|
| 1,351,469 | 8/1920 | Coleman | 254/415 |
| 3,105,596 | 10/1963 | Gagnon et al. | 212/213 X |
| 3,561,811 | 2/1971 | Turner | 414/22 X |
| 3,912,230 | 10/1975 | Learmont | 254/190 R |
| 3,929,235 | 12/1975 | Howard et al. | 414/22 |
| 3,937,515 | 2/1976 | Langowski | 294/88 |
| 4,013,178 | 3/1977 | Brown | 414/22 |
| 4,345,864 | 8/1982 | Smith et al. | 414/22 |

FOREIGN PATENT DOCUMENTS

| | | | |
|---|---|---|---|
| 566367 | 11/1958 | Canada | 254/415 |
| 967197 | 5/1975 | Canada | 212/214 |

OTHER PUBLICATIONS

B.J. Machinery Dwg., D-31450-8; dated 4/5/77.

*Primary Examiner*—Leslie J. Paperner

*Attorney, Agent, or Firm*—Robert A. Felsman; Charles D. Gunter, Jr.

[57] ABSTRACT

A pipe racking system is shown of the type having a vertical track, a lifting assembly adapted for vertical movement along the track, a horizontal beam for supporting the vertical track, and a movable carriage connecting the vertical track to the horizontal beam. The lifting assembly is supported by a wire rope running from the lifting assembly inside the vertical track and outside the carriage to a source of lifting power. A fixed guide sheave mounted in the carriage serves as a first point of contact for the wire rope running from the lifting head to the carriage. A rotatable guide sheave mounted in the carriage serves as a second point of contact for the wire rope. The rotatable guide sheave is rotatable by the wire rope in response to movement of the carriage, vertical track, and horizontal beam to center the wire rope in the guide wheel grooves of the guide sheaves during racking operations.

4 Claims, 4 Drawing Figures

BEAM TYPE RACKING SYSTEM

BACKGROUND OF THE INVENTION

The present invention relates generally to well pipe racking systems for moving pipe stands between racked positions and the well bore. Specifically, the present invention relates to a pipe racking system of the type used to support the vertical load of a stand of pipe while the stand is being transferred to or from the racking area on an offshore drilling platform.

In the drilling of oil and gas wells at offshore locations, it is common practice to rack the stands of drill pipe when the drill string is being tripped, as when the bit at the lower end of the drill string is being changed. Since a stand of drill pipe may be ninety feet in length, mechanized systems are desirable in offshore locations in restraining and handling the pipe stands to compensate for movement of the derrick which may be caused by pitching and rolling due to wave action.

The typical mechanized pipe handling system thus includes one or more racker arms and heads which are used to guide the pipe stands into and out of the racking area and to and from the rotary. In addition, some type of lifting mechanism is required to provide vertical lift so that the pipe stand can be maneuvered without dragging along the derrick floor. In one prior device, the lifting head was mounted for movement along a vertical track. A hydraulic cylinder located below the lifting head was used to provide lifting force. This device was suitable for smaller loads but could not handle the weight of larger diameter pipe or greater stand length.

In another prior design, a lifting head was mounted in a vertical track and the lifting head was connected by a wire rope which ran over the crown of the derrick to a hydraulic cylinder which provided lifting force. The vertical track did not rotate about the longitudinal axis of the track and the wire rope was guided by a roller at the top of the vertical track.

There has existed a need for a beam type racking system of the type having a vertical track with a lifting head mounted on the track and connected by a wire rope to a source of lifting power, which lifting head was capable of X, Y, and Z movement with respect to the axis of the vertical track as well as rotational movement about the vertical track axis. Once the lifting head is made rotatable with respect to the vertical track axis, the need exists for a wire rope guide to constrain the wire rope and prevent undue wear or entanglement of the wire rope with respect to the other components of the pipe racking system.

SUMMARY OF THE INVENTION

The present pipe racking system includes a vertical track, a lifting head adapted for vertical movement along the track and a horizontal beam for supporting the vertical track. A movable carriage connects the vertical track to the horizontal beam. The lifting head is supported by a wire rope running from the lifting head inside the vertical track and outside the carriage to a source of lifting power. A fixed guide means mounted in the carriage serves as a first point of contact for the wire rope running from the lifting head to the carriage. Rotatable guide means mounted in the carriage serve as a second point of contact for the wire rope. The rotatable guide means is rotatable about an axis which coincides with a line drawn along the path of the wire rope between the fixed and rotatable guide means in the carriage and tangent to each of the guide means.

Preferably the first guide means is a fixed sheave having a yoke secured to the carriage and a grooved wheel movably supported in the yoke for receiving a portion of the wire rope. The rotatable guide means comprises a rotatable sheave mounted on a rotatable bearing assembly which is mounted in the carriage. The rotatable sheave has a yoke extending outwardly from the bearing assembly and a grooved wheel movably supported in the yoke for receiving a successive portion of the wire rope.

A pair of horizontal tracks can be provided for slidably supporting the horizontal beam. A horizontal track motor moves the horizontal beam along the horizontal tracks. The vertical track is connected to the movable carriage by a bearing means which allows the track to rotate about the longitudinal axis of the track. A housing motor is provided to rotate the vertical track. A carriage motor is provided for moving the carriage along the horizontal beam. The rotatable guide means is rotated by the wire rope in response to movement in the carriage, vertical track and horizontal beam to center the wire rope in the guide wheel grooves during racking operations.

Additional objects, features, and advantages will be apparent in the written descriptions which follows.

DETAILED DESCRIPTION OF THE INVENTION

Figure 1:
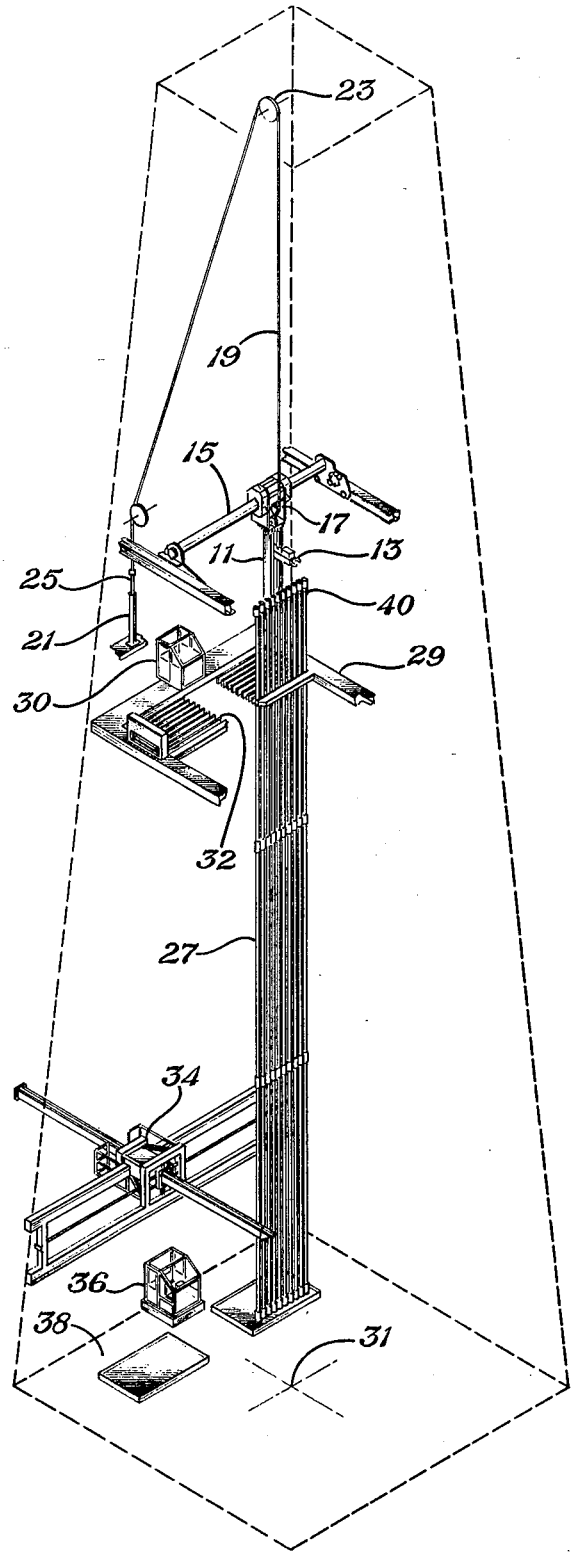
FIG. 1 is a simplified perspective view of the pipe racking system of the invention as it would appear on a derrick.

Turning to FIG. 1, there is shown a pipe racking system of the invention in place on a drilling rig. The pipe racking system includes a vertical track 11, a lifting assembly 13 adapted for vertical movement along the track 11 and a horizontal beam 15 for supporting the vertical track 11. A movable carriage assembly, designated generally as 17, connects the vertical track 11 to the horizontal beam 15.

The lifting assembly 13 is supported in track 11 by a wire rope 19 which runs from the lifting assembly 13 inside the vertical track 11 and outside the carriage assembly 17 to a source of lifting power 21. As shown in FIG. 1, the wire rope 19 can conveniently be run over a snatch block 23 located at the crown of the derrick and to a hydraulic cylinder having a shaft 25 which provides lifting force for the lifting assembly 13 in track 11.

As shown in FIG. 1, the pipe racking system also includes a racking area 29 including a racker's console 30 and a plurality of finger boards 32 for supporting one or more pipe stands 27. One or more intermediate racker's 34 can be provided for gripping and guiding the pipe stands 27 between the racking area 29 and the well bore or rotary 31. A driller's console 36 is shown on the rig floor 38.

Figure 3:
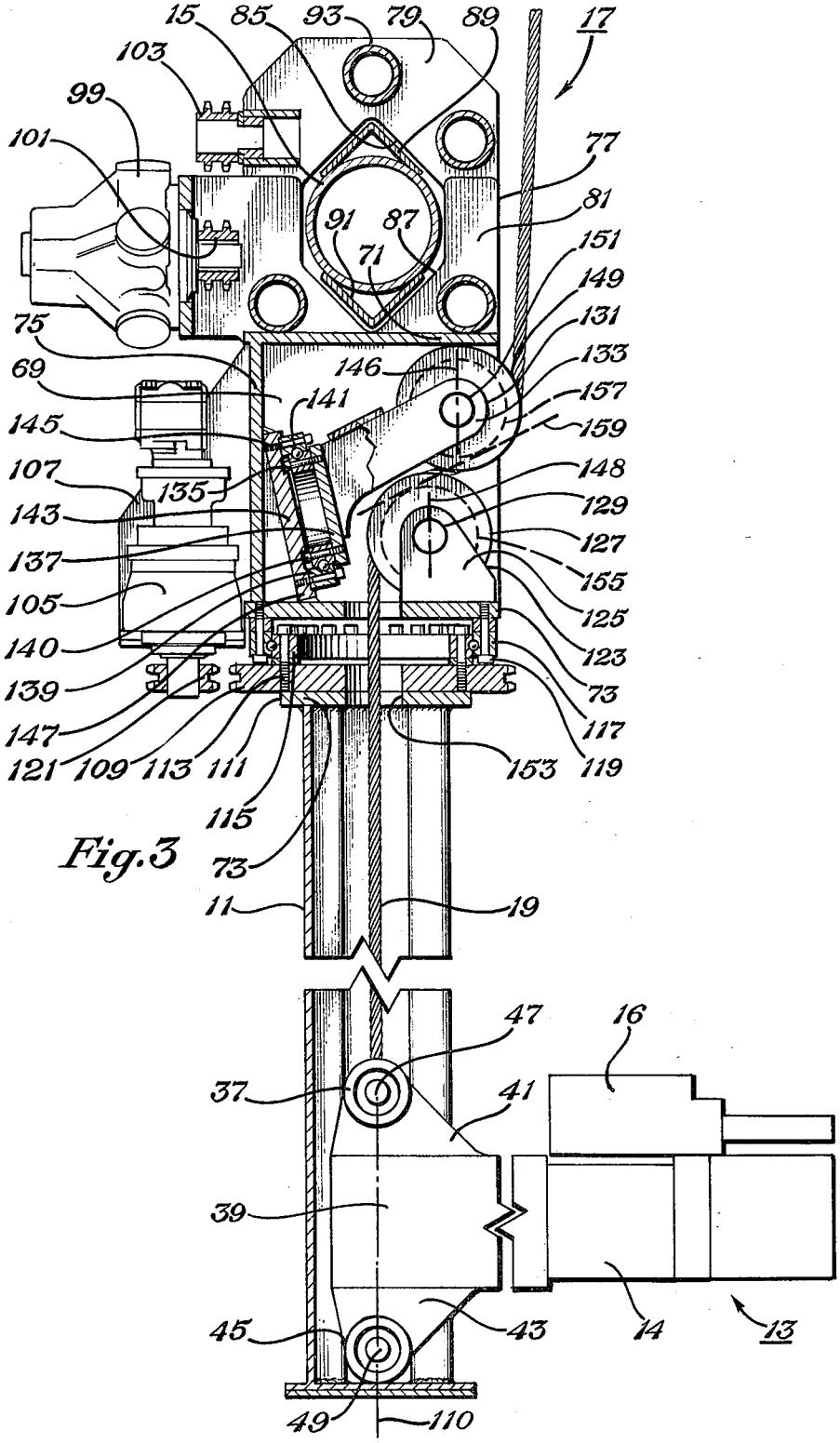
FIG. 3 is a partial cross-sectional view of the pipe racking system of FIGS. 1 and 2 showing the lifting head, vertical track, wire rope, and wire rope guide.

As shown in FIG. 3, the lifting assembly 13 includes a vertical dolley 14 to which is attached a conventional gripping and lifting head 16. Any suitable gripping and lifting head can be used with the lifting assembly 13 of the present racking system. For instance, the pipe racker gripping head shown in U.S. Pat. No. 3,937,515, issued Feb. 10, 1976, to Faustyn C. Langowski, and assigned to the assignee of the present invention could be used with the present pipe racking system. The lifting head 16 is used to grip and lift a stand of pipe 27, as below the tool joint 40, to lift and assist in maneuvering the pipe stand between the racking area 29 and the well bore or rotary 31.

Figures 2, 4:
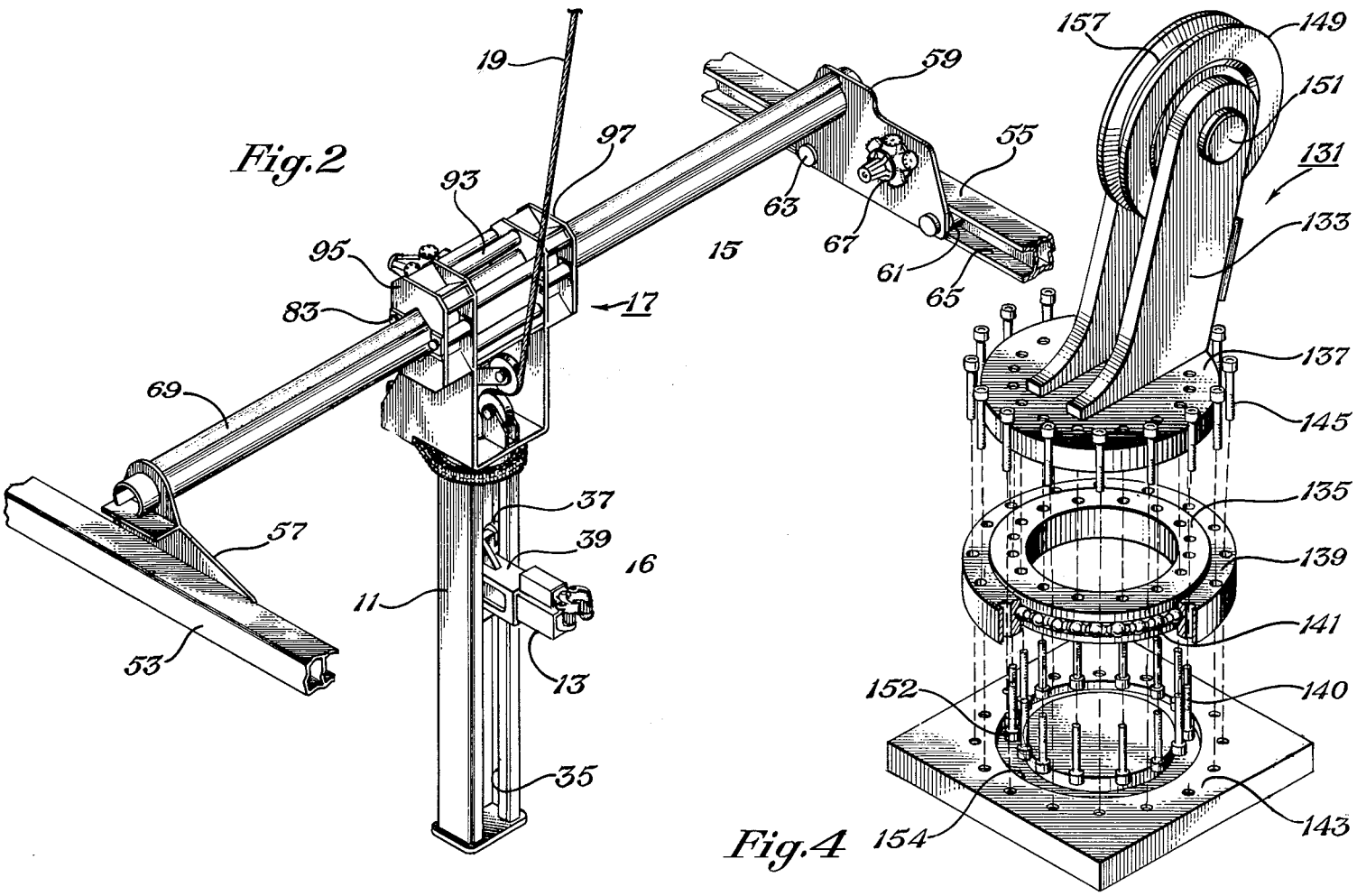
FIG. 2 is a close-up partial perspective view of the pipe racking system of FIG. 1 showing the wire rope guide in greater detail.
FIG. 4 is a close-up exploded view of the rotatable guide sheave of the wire rope guide of FIG. 3.

Turning now to FIG. 2, the lifting head assembly is shown in greater detail. The vertical track 11 is a U-shaped channel 33 having a pair of vertical tracks 35 on either side of the channel opening for receiving the rollers 37 (FIG. 3) of lifting assembly 13. As best seen in FIG. 3, lifting assembly 13 has a central body portion 39 with upper and lower flanges 41, 43 extending therefrom. Matching roller pairs 37, 45 are mounted on pins 47, 49 passing through flanges 41, 43 respectively. A gripping and lifting head 16 such as that shown in U.S. Pat. No. 3,937,515 is shown in simplified form in FIG. 3 carried on the lifting assembly 13 for gripping and supporting a pipe stand.

A wire rope 19 is connected to upper flange 41 between rollers 37 which runs through the inside of vertical track 11 and outside the carriage assembly 17.

As shown in FIG. 2, the pipe tracking system includes a pair of horizontal tracks 53, 55 for slidably supporting the horizontal beam 15. Beam 15 is supported at either end thereof by a bracket assembly 57, 59 which includes a pair of rollers 61, 63 which ride in channels 65. A horizontal track motor 67 is provided for moving the horizontal beam 15 and bracket assemblies 57, 59 along the horizontal tracks 53, 55.

Movable carriage assembly 17 is shown in greater detail in FIG. 3. The carriage assembly 17 has a housing 69 including top and bottom walls 71, 73 and a rear wall 75. A box 77 having a lid portion 79 and base portion 81 is coupled about horizontal beam 15 for movement along the length thereof by a series of pins 83, best seen in FIG. 2. Lid portion 79 and base portion 81 have V-shaped openings 85, 87 in the interiors thereof for receiving the horizontal beam 15. As shown in FIG. 3, horizontal beam 15 can comprise a tubular conduit to which has been welded a pair of upper and lower angle irons 89, 91. Angle irons 89, 91 are received within V-shaped openings 85,87 within box 77 and provide a convenient roller surface for two pairs of rollers (not shown) located within the interior of box 77 which facilitate the lateral movement of box 77 along the length of horizontal beam 15. As shown in FIGS. 2 and 3, one or more reinforcing tubes 93 can be provided between the end walls 95, 97 of box 77 to provide additional strength.

Carriage motor means including beam motor 99 are provided for moving the carriage assembly 17 along the horizontal beam 15 by means of drive sprocket 101 and one or more idler sprockets 103. A chain (not shown) is carried on sprockets 101, 103 and runs between brackets 57, 59 immediately behind horizontal beam 15.

The carriage motor means also includes housing motor 105 which is mounted in a rearward extension or compartment 107 of housing 69. As shown in FIG. 3, vertical track 11 has a driven sprocket 109 fixedly attached to an upper plate 111 which sprocket is secured by a plurality of bolts 113 to a rotatable bearing 115 which is in turn carried in a circular bearing race 117 which is supported by means of bolts 119 from bottom wall 73 of housing 69. Housing motor 105 has a downwardly extending drive sprocket 121 which engages driven sprocket 109 by means of a suitable drive chain (not shown) for rotating the vertical track 11 about the longitudinal axis 110 of the vertical track.

A wire rope guide assembly is contained within housing 69 and includes a fixed guide means or sheave 123 mounted in housing 69 and serving as a first point of contact for wire rope 19 running from lifting head 13 to the housing 69. Fixed guide sheave 123 has a yoke 125 secured to the bottom wall 73 of housing 69 and a grooved wheel 127 which is movably supported by means of a shaft 129 in yoke 125.

A rotatable guide means (FIGS. 3 and 4) including rotatable guide sheave 131 is mounted in housing 69 and serves as a second point of contact for wire rope 19 running from lift assembly 13. Rotatable sheave 131 has a yoke 133 which extends outwardly from a rotatable bearing assembly 135, similar to bearing 115, which is connected to yoke base 137 by a series of circumferential bolts 140. Rotatable bearing 135 is carried in a circular bearing race 139 and is separated therefrom by a plurality of balls 141. Circular race 139 is in turn mounted on a base member 143 by a series of bolts 145, base member 143 being welded between bottom wall 73 and rear wall 75 of housing 69. The heads 152 (FIG. 4) of bolts 140 ride in a circular groove 154 in base member 143. The lower end 147 (FIG. 3) of base member 143 forms an acute angle with respect to bottom wall 73, whereby yoke 133 and sheave 131 extend above fixed sheave 123 in housing 69. As seen in FIG. 3, a vertical axis 146 drawn through the center of mounting shaft 151 of sheave 131 is staggered and located slightly to the right of a vertical axis 148 drawn through the center of mounting shaft 129 of sheave 127.

Wire rope 19 passes from lifting head 13 through an opening 153 in upper plate 111 of vertical track 11 and wire rope 19 then passes through a similar opening in bottom wall 73 of housing 69 through grooved wheel 127 of fixed sheave 123 and through grooved wheel 149 of rotatable sheave 131 and out of the carriage assembly 17. As best seen in FIG. 3, rotatable sheave 131 rotates by means of rotatable bearing 135 in an arc-like path about a locus of points drawn through the center of mounting shaft 151 in the plane of the vertical axis 146 drawn through said shaft.

In operation, the wire rope 19 is run from the lifting assembly 13 through the vertical track 11 through the wire rope guide assembly and outside the rotatable carriage assembly 17. The wire rope 19 is then run over a snatch block 23 at the derrick crown and connected to the shaft 25 of lifting cylinder 21. During pipe lifting and guiding operations, the rotatable guide sheave 131 is rotated about the rotatable bearing assembly 135 by the wire rope 19 in response to the movement of the carriage assembly 17, vertical track 11, and horizontal beam 15 to center the wire rope 19 in the guide wheel grooves 155, 157 of sheaves 123, 131. The rotatable sheave 131 is rotatable about an axis 159 (FIG. 3) which coincides with a line drawn along the path of the wire rope 19 between the fixed and rotatable sheaves 123, 131 in the carriage assembly 17 and tangent to each of the sheaves 123, 131. The wire rope guide allows the carriage assembly 17 to move along the horizontal beam 15, the horizontal beam 15 to run along the horizontal tracks 53, 55, and the vertical track 11 to rotate while the wire rope 19 maintains a zero degree fleet angle with both sheaves 123, 131 of the guide. By "fleet angle" is meant the deviation from the vertically centered or optimum position of the wire rope in the sheave grooves.

An invention has been provided with significant advantages. The present pipe racking system can position the lifting head in any desired location in the X, Y, or Z direction including intermediate angular positions resulting from rotation of the vertical track 11 about the longitudinal axis 110 of the track. The lifting head is connected by a wire rope to a lifting cylinder to enable the pipe racking system to handle greater loads than previously possible. The position of the wire rope with respect to the movable carriage and horizontal beam is controlled by means of a novel sheave arrangement including a rotatable sheave which is rotated by the wire rope in response to movement of the carriage, vertical track, and horizontal beam to center the wire rope in the guide wheel grooves during racking operations. By maintaining a zero fleet angle with respect to the guide sheaves, wear on the wire rope is reduced and the lifting efficiency of the system is increased.

While the invention has been shown in only one of its forms, it is not thus limited but is susceptible to various changes and modifications without departing from the spirit thereof.

I claim:

1. A pipe racking system comprising:

a vertical track, rotatable about a vertical axis;

a lifting assembly adapted for vertical movement along said track;

a horizontal beam for supporting said vertical track;

a movable carriage connecting said vertical track to said horizontal beam;

said lifting assembly being supported by a wire rope running from said lifting assembly inside the vertical track and outside the carriage to a source of lifting power;

a fixed sheave mounted in said carriage and serving as a first point of contact for said wire rope running from said lifting head to said carriage; and a rotatable sheave mounted in said carriage and serving as a second point of contact for said wire rope, said rotatable sheave being rotatable about an axis which coincides with a line drawn along the path of the wire rope between the fixed and rotatable sheave in said carriage and tangent to each of said sheaves.

2. The pipe racking system of claim 1, wherein said fixed sheave comprises a yoke secured to said carriage and a grooved wheel movably supported in said yoke for receiving a portion of the wire rope.

3. The pipe racking system of claim 2, wherein the rotatable sheave is mounted on a rotatable bearing assembly mounted in said carriage, said rotatable sheave having a yoke extending outwardly from said bearing assembly and a grooved wheel movably supported in said yoke for receiving a successive portion of said wire rope.

4. The pipe racking system of claim 3, further comprising:

a pair of horizontal tracks for slidably supporting said horizontal beam;

horizontal track motor means for moving said horizontal beam along said horizontal tracks;

carriage motor means for rotating said vertical track about the longitudinal axis of said vertical track and for moving said carriage along said horizontal beam;

said rotatable sheave being rotated by said wire rope in response to movement of said carriage, vertical track and horizontal beam to center said wire rope in said guide wheel grooves during racking operations.

* * * * *